United States Patent [19]

Nuckols

[11] Patent Number: 5,069,285

[45] Date of Patent: Dec. 3, 1991

[54] DUAL WALL WELL DEVELOPMENT TOOL

[76] Inventor: Thomas E. Nuckols, 1531 Ramona Ave., South Pasadena, Calif. 91030

[21] Appl. No.: 284,087

[22] Filed: Dec. 14, 1988

[51] Int. Cl.[5] ..... E21B 37/08

[52] U.S. Cl. ..... 166/311; 166/68; 166/105; 166/177; 166/372

[58] Field of Search ..... 166/311, 312, 173, 177, 166/171, 170, 372, 68, 105, 202

[56] References Cited

U.S. PATENT DOCUMENTS

| | | | |
|---|---|---|---|
| 764,684 | 7/1904 | Shaw | 166/68 |
| 1,484,601 | 2/1924 | Carmichael | 166/68 X |
| 1,888,315 | 11/1932 | Gault | 166/68 |
| 2,259,262 | 10/1941 | Moehrl | 166/68 X |
| 2,423,653 | 7/1947 | Lauman | 166/68 |
| 3,760,878 | 9/1973 | Peevey | 166/311 X |
| 4,040,486 | 8/1977 | Kirkland, Jr. | 166/311 |
| 4,609,045 | 9/1986 | Rogers | 166/312 |
| 4,744,420 | 5/1988 | Patterson et al. | 166/312 |
| 4,763,728 | 8/1988 | Lacey | 166/312 X |

*Primary Examiner*—Hoang C. Dang

*Attorney, Agent, or Firm*—Christie, Parker & Hale

[57] ABSTRACT

Well development tooling particularly useful in medium size wells has a suction head or a development head which may be fitted to an eduction pipe. The eduction pipe is made from serially connectible double walled pipe sections with an inner conduit surrounded by a coaxial outer conduit. The outer conduit of each section extends beyond the inner conduit. The outer conduit is threaded on each end so that a removable slip connector joins the inner conduits of adjacent pipe sections when the outer conduits are screwed together. The eduction pipe has an eduction nozzle for redirecting fluid from the outer conduit upwardly into the inner conduit to create an eduction effect in the inner conduit for drawing well fluid upwardly out of the well. The development and suction heads have a fluid conduit which may be connected to the inner conduit of the eduction pipe. The development head has a wiper which slides against the walls of the well.

6 Claims, 5 Drawing Sheets

20
18
22
16
15
14
17
12
10

36
32
34
28-1
22
28-2
24
10
12
38
28-3
42
4
4
24
44
38
26
46
50
54
54
48
52

DUAL WALL WELL DEVELOPMENT TOOL

FIELD OF THE INVENTION

This invention pertains to development of small and medium diameter wells such as environmental and monitoring wells.

BACKGROUND OF THE INVENTION

Well technology has reached two extremes. Shallow water wells are usually small in diameter, simple and primitive. They involve little more than drilling a hole down to the water table and installing a pump in association with a casing placed in the drilled hole. The hole is seldom more than one hundred feet deep and water simply pours into the hole from the water table. Oil and gas wells are on the other extreme. These wells are often miles deep, are of substantially larger diameter, and are drilled using very expensive and complex technologies, such as diamond tipped drill bits and mud pulse telemetry.

In between these extremes is a field of medium size wells for which technology is largely undeveloped. These medium size wells are typically less than a thousand feet deep (300 m.) and about four inches (10 cm.) in diameter. They reach down to, or below, the water table and have a variety of uses. Some are simply deep water wells. Environmental wells normally fall into this category as well. Environmental wells are used to monitor sub-surface ground water conditions. For example, at a sanitary landfill, environmental wells may be used to monitor contaminants entering the water table or to monitor or vent sub-surface accumulations of methane gas.

Completing an environmental well requires three steps, drilling, development and pumping. In drilling, the well is drilled into a formation using known techniques and a perforated casing, normally made of steel, stainless steel or polyvinylchloride (PVC) is placed in the drilled well to secure the walls. A gravel pack is often placed between the casing and the formation to filter whatever fluids seep or flow into the well from the formation and to stabilize the formation material around the casing.

Development must be done both initially and as a matter of periodic well maintenance. In development, the well is cleaned of loose formation and mud particles and other unwanted residue, and the gravel pack surrounding the well casing is cleaned and settled.

Air surging, in which high pressure air is blasted into the well, is a common method of development but it tends to drive the finer grained particles back into the gravel pack, clogging both the gravel pack and sealing off the formation material, thus reducing the water production of the well.

Surge blocks, which are essentially plungers reciprocated within the well, are also used. When driven up and down within the casing, the surge block forces fluid in the well back and forth through the casing perforations and the gravel pack, and such flow tends to rinse the gravel pack. However, a surge block is effective only when combined with bailing to remove the dirtied liquid out of the well. Bailing involves the use of equipment different from a surge block. The well must be first surged, then bailed, then surged, then bailed and so on, until the well is sufficiently developed. This is very time consuming, especially in deep wells. None of these development techniques allow any control over where within the well the development is occurring.

The third step is pumping in which the ground water and contaminants, or whatever else the well produces is pumped out of the well.

The development process, which must be periodically repeated, is presently expensive and time consuming given the size of these intermediate size wells. Equipment developed for oil and gas drilling is too complex to be useful or cost effective for medium size wells, and equipment developed for water wells is too large and primitive to accomplish the job. Therefore, there is a need for practical and effective development tools specifically suited to medium sized wells like environmental wells.

SUMMARY OF THE INVENTION

The present invention provides development tools which are well suited to medium size wells and allow localized development. The invention includes a suction tool comprising an eduction pipe and a suction head. The eduction pipe has top and bottom ends with a first fluid conduit extending from one end of the pipe to the other end for conducting fluid up out of the well and a second fluid conduit extending from the top end of the pipe down towards the bottom end of the pipe. There is at least one eduction nozzle coupled between the conduits for injecting fluid from the second conduit upwardly into the first conduit.

A suction head provided by the invention is mountable to the bottom of the pipe and has a suction conduit through it coupled to the eduction pipe's first conduit for conducting fluid from the exterior of the suction head to the first fluid conduit of the eduction pipe. The suction head may be provided with a coupling for connecting the second conduit of the eduction pipe to a source of pressurized fluid, for example, compressed air, and the first fluid conduit may be connected to a reservoir. The eduction pipe may be formed of a plurality of serially connectible pipe sections and the fluid conduits within the eduction pipe may be concentric.

The invention also provides a development tool for use in a well with fluids. The development tool includes a development head with at least one wiper around the exterior of the head for slidably sealing with the walls of a well casing and a head fluid conduit for conducting fluid out of the well from a location outside the head and proximate the wiper. Alternatively, the head may be formed of a pipe having at least two spaced apart wipers around the pipe for slidably sealing with the walls of the well casing and at last one opening proximate the wipers for connecting the pipe's exterior to a fluid conduit which conducts the fluid out of the well. The development tool may also comprise an eduction pipe with a first fluid conduit extending from the top end of the pipe and connecting with the development head fluid conduit at the bottom end of the pipe for conducting the first fluid from the development head to the top of the pipe, and a second fluid conduit extending from the top end of the pipe towards the bottom end of the pipe and having a junction with the first fluid conduit for introducing a second fluid from the second fluid conduit upwardly into the first fluid conduit.

The invention also provides a slip connector for use in connecting two sections of double walled pipe, end to end, where each section of double walled pipe has an inner conduit and an outer conduit, and the outer conduit extends beyond the ends of the inner conduit and is threaded at opposite ends. The connector comprises an elongated tube configured at each end to slide onto and seal against an end of the inner conduit of a double walled pipe section, the length of the tube being chosen so that when the threaded ends of the outer conduits of the two pipe sections are screwed together, the tube extends between the adjacent ends of the inner conduits and seals to the adjacent inner conduit ends.

The present invention also provides a method for developing a well where the well is subject to seepage into the well and has a perforated casing surrounded by a gravel packing. The method comprises the steps of driving seepage through the perforations and around the gravel packing by reciprocating a development head within the well, allowing seepage to return to the well from the gravel packing through the perforations, and drawing seepage out of the well through the development head.

BRIEF DESCRIPTION OF THE DRAWINGS

The above-mentioned and other features of this invention are set forth more fully in the following detailed description of presently preferred embodiments of the several aspects of the invention, which description is presented with reference to the accompanying drawings, wherein.

DETAILED DESCRIPTION

Figure 1:
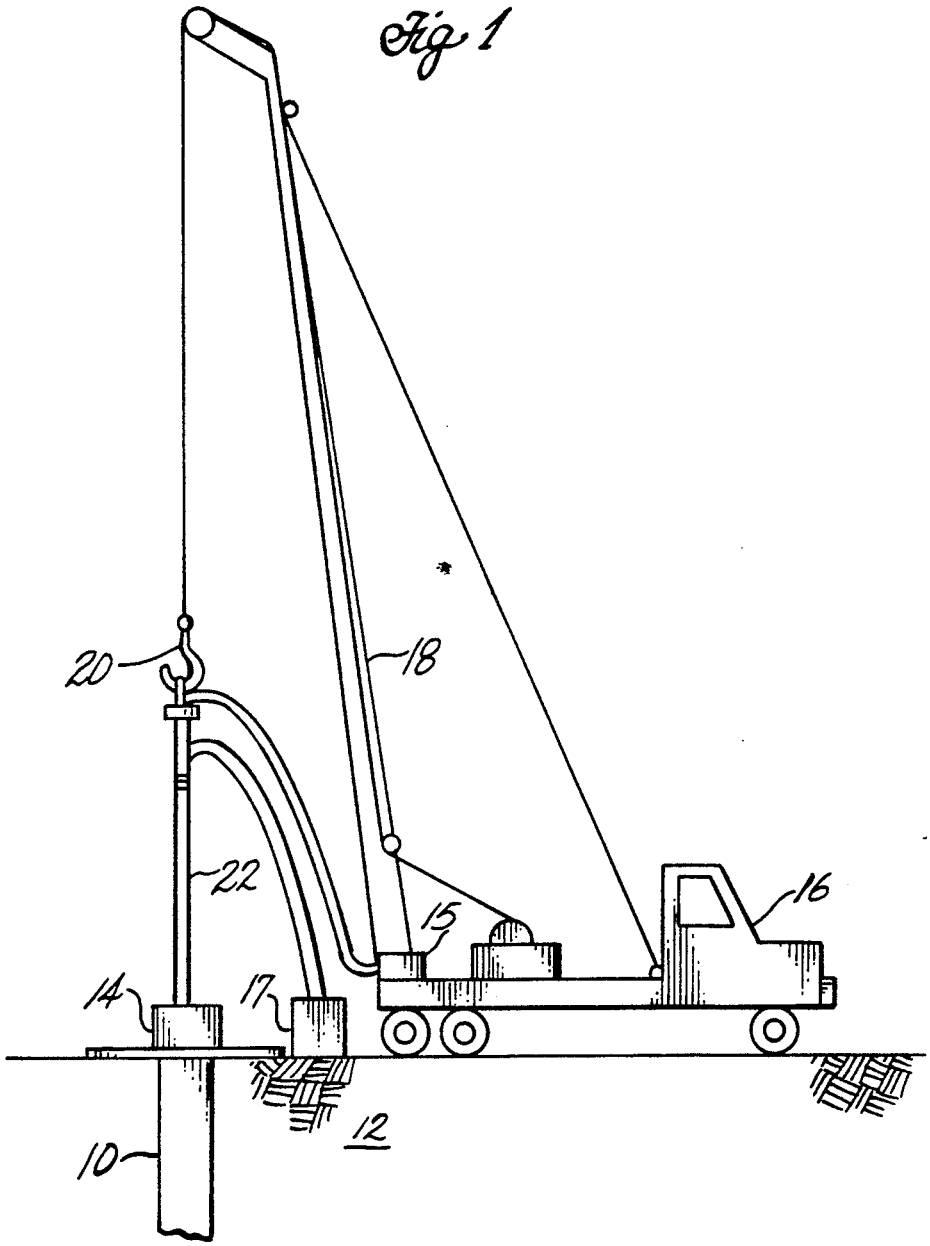
FIG. 1 is a side elevational view showing the environment of the invention including a development tool, a we a wireline well service truck.

FIG. 1 shows the general environment in which an exemplary embodiment of the present invention operates. A well 10 has been drilled into the formation 12 by a conventional drilling device, for example, a mobile drilling rig, to the desired depth. A casing and gravel pack have been installed in the well (not shown), and a wellhead 14 has been placed at the top of the well.

For development, a conventional wire line service truck 16 is driven to the site and, using a crane 18 with a hook 20, raises and lowers the development tooling 22 in the well 10. An air compressor 15 connects to the tooling to drive an eduction pump and reservoir 17 connects to the tooling to collect material removed from the well.

Figure 2:
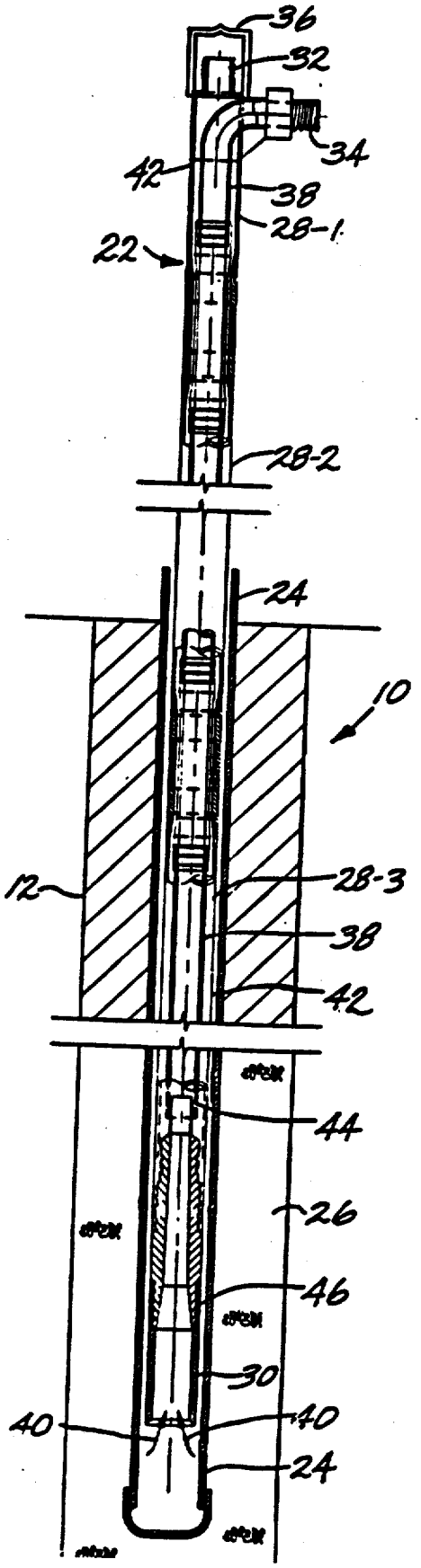
FIG. 2 is a fragmentary cross-sectional elevation view of a suction tool according to the present invention inserted well via a double-wall pipe according to the invention.

FIG. 2 shows the development tooling 22 and the well 10 in greater detail. The well 10 has an annular casing 24 to support the well 10 against the formation 12. The casing is typically made of stainless steel, PVC or fiberglass, however, other materials may also be used. In the well of FIG. 2 there is also a gravel pack 26 near the bottom of the well 10 around the outside of the casing in the drilled well base. The casing is perforated near the bottom so that gases and liquids may flow into the well 10 from the formation 12. The gravel pack 26 acts as a filter and stabilizer between the perforations in the casing 24 and the formation 12 to prevent larger particles from flowing into the well from the formation. The well 10 may be perforated in other places rather than just the bottom of the well, and a gravel pack may be placed anywhere along the length of the well 10.

The development tooling 22 of FIG. 2 has an eduction pipe 28 and a suction head 30. The eduction pipe is made up of removable sections 28-1, 28-2, 28-3, etc. The top section 28-1 has an upward facing air fitting 32 for connection to an air compressor 15, and a sideways facing outlet fitting 34 for connection to a hose that leads to a reservoir 17. It also has a bracket 36 so that the hook 20 of the well service truck can hold the development tooling 22.

The outlet fitting 34 connects into an inner conduit 38 which extends all the way through the eduction pipe sections 28 to the suction tool 30. Any material drawn into the suction tool 30 in the direction indicated by the arrows 40 is moved through the inner conduit 38 and out the outlet fitting 34. The type of material depends on the well but it may be debris, silt, water or any other material.

The air fitting 32 connects to an outer conduit 42 preferably concentric with the inner conduit 38 (see e.g. FIG. 4) although other geometries may be used. The outer conduit extends along the eduction pipe 28 to an eduction nozzle 44 which is explained in more detail with regard to FIG. 6. The eduction nozzle 44 reverses the air flow sending it back up the inner conduit 38 to the outlet fitting 34. This creates a suction by eduction which drives the suction head 30.

In the arrangement of FIG. 2, the suction head 30 and eduction pipe 28 together make up a suction tool. They are held together by a threaded connection 46 and can be moved up and down to any location in the well 10 using the bracket 36. The length of the tooling can be varied by adding or removing sections of eduction pipe 28. It is presently preferred that each section of eduction pipe be approximately twenty feet (6 m.) long. A twenty foot (6 m.) well could then be serviced using a single section of eduction pipe whereas, for example, a two hundred foot (60 m.) well would require ten sections to reach the bottom.

Figure 3:
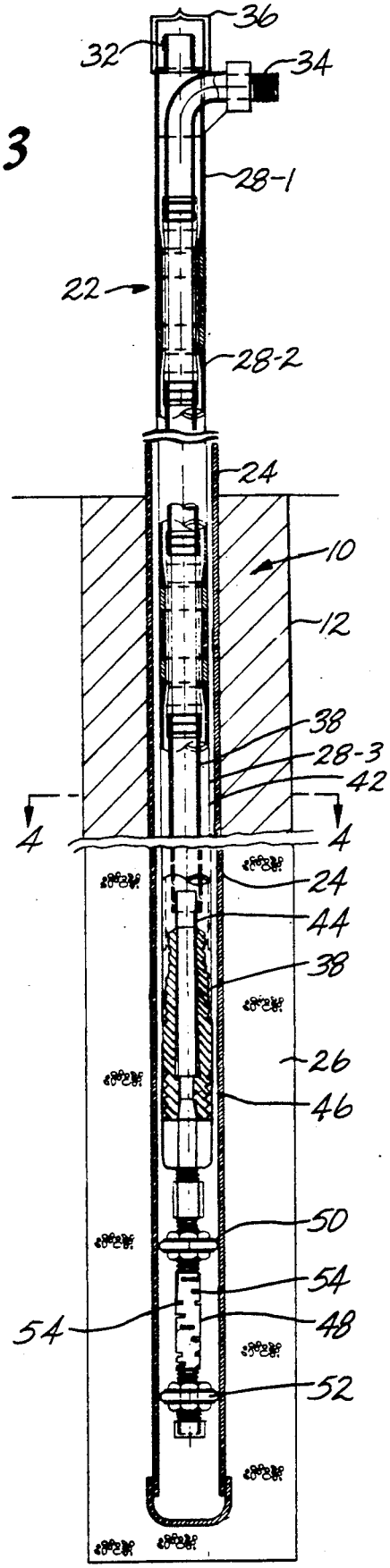
FIG. 3 is a fragmentary cross-sectional elevation view, similar to FIG. 2, showing a development tool according to the invention inserted into a well.
Figure 3:
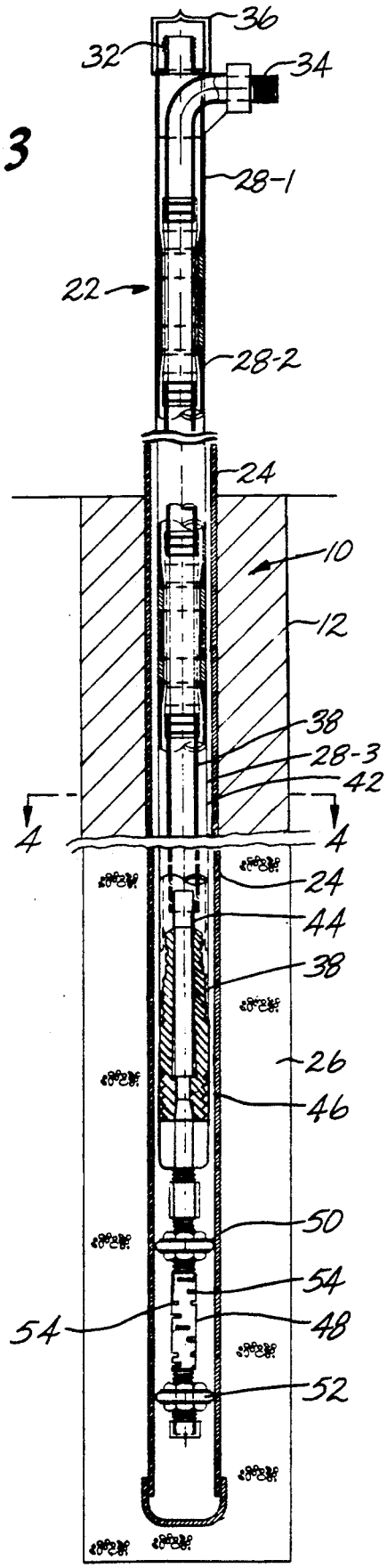

FIG. 3 shows development tooling in place in well 10 with a development head 48 connected to pipe 28 instead of suction head 30. The development head 48 is described in greater detail with reference to FIG. 7.

As can be seen in FIG. 3 the development head 48 has two annular wipers 50, 52 which ride against the well casing 24.

Between the packings 50, 52 the development head 48 has perforations 54 which connect to the inner conduit 38 of the eduction pipe 28 so that material in the casing between the packings 50, 52 may be drawn by eduction through the outlet fitting 34 in the same way that material is drawn into the suction head 30 of FIG. 2.

Figure 4:
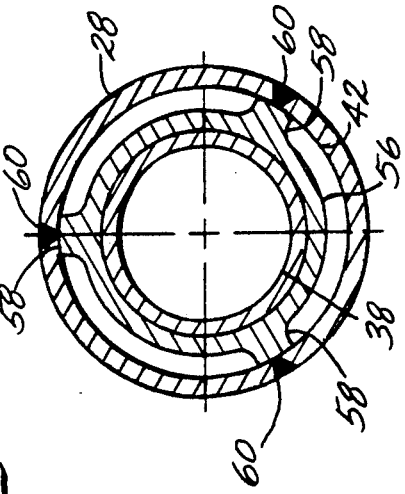
FIG. 4 is a transverse cross-section view of the double-wall shown in FIGS. 2 and 3 and taken along line 4—4 in 3.

FIG. 4 shows a cross-sectional view of a section of eduction pipe 28 taken near its mid point. The eduction pipe section 28 has an inner conduit 38 placed inside of an outer conduit 42. The inner conduit is held in place by a spacer 56. The spacer has a thin ring which surrounds the outer surface of the inner conduit 38 and three ribs 58 which extend out from the ring to the inner surface of the outer conduit 42. Three holes 60 are drilled in the outer conduit 42 directly over the ribs 58 and the ribs 58 are then welded through the holes to the outer conduit. A twenty foot (6 m.) section of eduction pipe will preferably use three spacers 56 placed evenly along the section.

Figure 5:
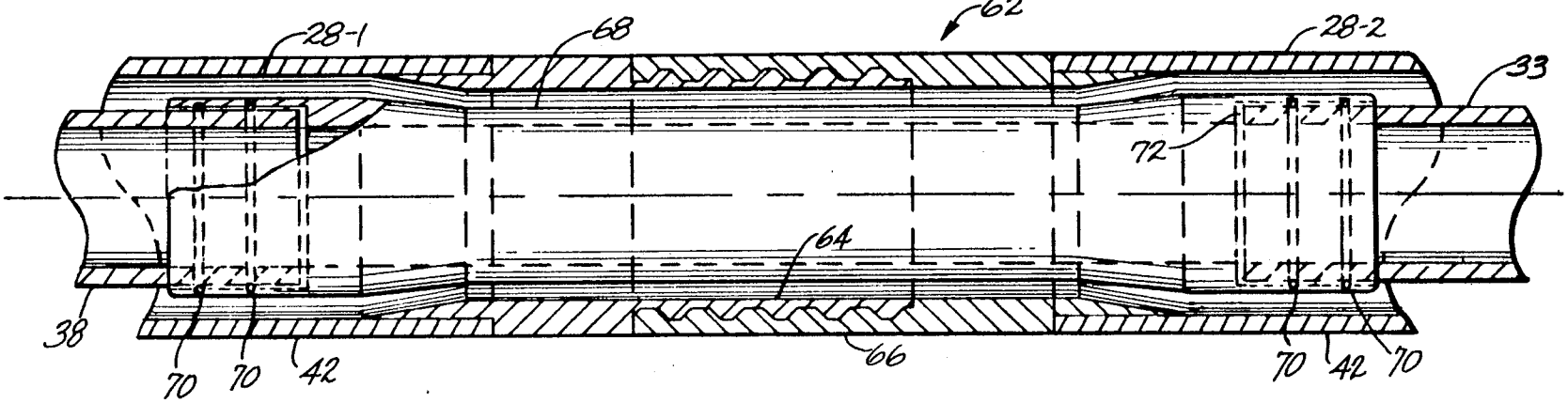
FIG. 5 is an enlarged cross-sectional elevation view of the connection joint of the pipe shown in FIGS. 2

FIG. 5 illustrates a slip joint connection 62 used to connect the eduction pipe sections 28, for example, sections 28-1 and 28-2. The inner conduit 38 of each pipe section 28-1, 28-2 is shorter than the outer conduit 42 and has its ends located inwardly along the length of the section from the ends of the outer conduit. The ends of inner conduit 38 are therefore protected from impacts by the outer conduit 42. The outer conduits 42 are internally and externally threaded at respective ends so that the pin end 64 of one pipe section 28-1 screws into the box end 66 of the other section 28-2. A slip connector 68 is used to join the inner conduits 38. The slip connector 68 has two internal O-ring type seals 70 at each end which fit around the outer ends of the inner conduits 38. A stop 72 after the innermost seal at each end of the connector limits the travel of the connector axially along a received inner conduit.

Using a slip connector 68, two eduction pipe sections 28 can be quickly joined by, first, sliding one end of a slip connector over the inner conduit 38 of one of the sections (e.g., section 28-1) until it reaches the stop 72, and, second, screwing the other pipe section (e.g., section 28-2) into the threads of the one pipe section. The length of the slip connector is designed, as shown in FIG. 5, so that when the pipe sections 28 are screwed together completely, the inner conduits 38 substantially abut against the slip connector stops 72. As a result, screwing the pipe sections 28 together necessarily pushes the inner conduit 38 of the other pipe section into the end of the slip connector 68 as carried by the adjacent end of the one pipe section.

The slip joint connection 62 can be quickly coupled and uncoupled, and the 0-ring seals insure that the inner conduits do not leak. In addition, the pipe sections 28 can be constructed so that the inner conduit 38 is protected inside the outer conduit 42. This avoids the common problem with double walled pipe that a protruding inner conduit is easily bent out of alignment during shipping and handling. Variations can be made to the design shown in FIG. 5. For example, the connector 68 could be made to slide into rather than around the inner conduits 38. The type of seals used and the arrangement for attaching the outer conduits 42 together could also be varied using known techniques.

Figure 6:
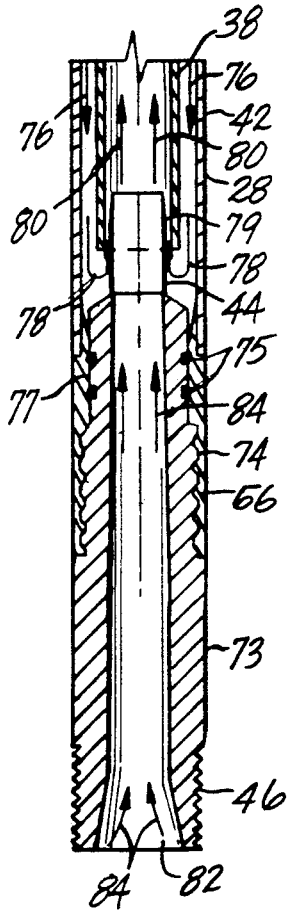
FIG. 6 is an enlarged cross-sectional elevation view of the nozzle shown in FIGS. 2 and 3.

FIG. 6 shows the eduction nozzle 44 which is screwed onto the lowermost eduction pipe section 28. Nozzle 44 is arranged to cooperate with any section of the eduction pipe so that any one of the several sections of that pipe can be used as its lowermost section. The nozzle 44 has a tubular body 73 with threads 74. The threads screw into the threaded box end 66 of an eduction pipe section 28 to seal off the end of the outer conduit 42. The threads 74 duplicate the threads on the pin end of an eduction pipe section 28. The nozzle 44 extends from the threads 74 upwards through the box end of the eduction pipe 28 into the inner conduit 38 of the pipe section 28. Above those external threads is a barrel 77 which extends through the box end fitting or the pipe sections. O-ring seals cooperate between the barrel 77 and the box end fitting to seal the connection of the nozzle 44 to the eduction pipe section 28.

When the nozzle 44 is in place in the lower end of the eduction pipe, the upper end of the barrel 77 lies below the lower end of the inner conduit in the eduction pipe. A tubular nipple 79 is carried concentric to the axial bore of the nozzle body 73 extending the body bore into the inner conduit 38 of the eduction pipe 28. The outer diameter of the nipple is a selected amount less than the inner diameter of inner conduit 38 so that an annulus is formed between the nozzle and the inner conduit, and that annulus is in fluid flow communication with the annulus passage formed in the eduction pipe between its inner and outer conduits. As a result, pressurized air which is being forced down through the outer conduit 42 as shown by arrows 76 is reversed, as shown by arrows 78 and forced to flow up through the inner conduit 38, as shown by arrows 80.

The nozzle 44 is rather massive in comparison to the rest of the tooling. It therefore acts like a plumb bob for the development tooling to assist in inserting the eductor pipe into the well. The tooling may require this assistance because the well may not be straight or vertical throughout its entire length. The mass also pulls the eduction pipe downwards by gravity which is helpful when the development head is being used to settle and clean the gravel pack.

The nozzle also extends from the threads 74 downward and ends in a suction inlet 82 and a threaded connection 46. The suction inlet 82 opens into a head (not shown) which is connected at the threaded connection 46. Either a suction head 30 or development head 48 may be used, for example. Flow induced by eduction is guided by the nozzle 44 from the head into the inner conduit 38 as indicated by arrows 80, 84.

Figure 7:
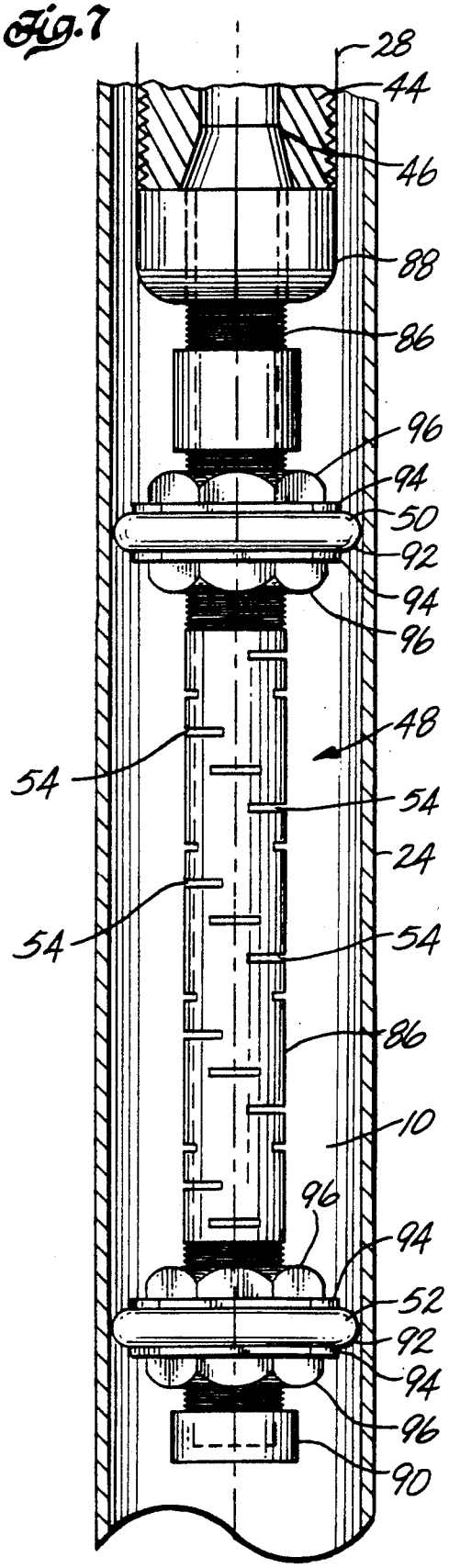
FIG. 7 is an elevation view of the development head shown in FIG. 3.

FIG. 7 shows the development head 48, also shown in FIG. 3, connected to the nozzle 44 of the eduction pipe 28. The development head includes a pipe 86 which preferably has external threads at each end. At the top end the pipe 86 screws into a mount collar 88 which connects onto the externally threaded lower end connection 46 of the eduction nozzle 44 at the lower end of the eduction pipe 28. The mount 88 is constructed so the inner passage of the pipe 86 communicates into the bottom of the nozzle 44 and through the nozzle 44 to the inner conduit 38 of the eduction pipe section 28 (See e.g. FIG. 3). A cap 90 seals off the bottom of the pipe 86.

Between its threads ends, the pipe 86 has a series of perforations 54 which connect the interior of the well 10 with the suction created in the eduction pipe 28. Accordingly, a fluid in the well near the perforations will be drawn into the development head pipe 86 and out through the outlet fitting 34 at the top of the eduction pipe 28, see e.g. FIG. 3.

Above and below the perforations 54 are the annular wipers 50, 52. Both are constructed of flexible synthetic rubber type packings 92 held in place by washers 94 which are held by nuts 96 engaged with the external threads of the development head pipe 86. The packings 50, 52 can be removed and replaced with newer or different sized packings by removing the nuts 96 and washers 94. The packings are chosen according to the inside diameter of the well casing 24. It is preferred that the packings 50, 52 be only slightly smaller in diameter than the well casing 24, as shown in FIG. 7, so that the packings act as wipers when the development head 48 is reciprocated to force any fluid near the packings into motion within the well. Different sized packings are therefore required for different sized wells.

In operation of the development tooling, a suitable head is chosen for use. If the well 10 is simply to be vacuumed then the suction head 30 is chosen. However, if extensive development is required, the development head 48 is chosen. The selected head is screwed onto eductor nozzle 44 which in turn is screwed onto the box end of a first eduction pipe section 28. The pipe section 28 is lowered into the well 10 using the crane 18 on the well service truck 16 until only the pin end of the first pipe section extends out of the well. Then a slip connector 68 is placed over the protected inner conduit 38 of the pipe section 28 and a second pipe section is screwed onto the first section. Pipe sections 28 are added until the desired depth is reached. The top end of the topmost eduction pipe section 28-1 which carries the inlet and outlet fittings 32, 34 is connected last. The outlet fitting 34 is connected to a fluid storage reservoir and the air fitting 34 is connected to an air compressor. The tool is then ready for use.

For simple vacuuming, i.e., simple cleaning of liquid and sludge from the well, the air compressor is turned on and the suction tool is used to remove fluid, mud, or sludge from the bottom of the well 10. For more complex cleaning and development of the well, the development head with the proper sized packings 50, 52 is used.

The development head 48 can be used for suction alone by applying compressed air to the air fitting 32, and it can also be used as a surge block combined with suction. This latter utility of the development head is significant in the context of liquid extraction for monitoring wells in or adjacent to sanitary landfills and in other wells where liquid flowing into the well may contain fine sand or other small particles. Over time, those fine particles flowing toward the well can accumulate in the gravel pack and clog the filter provided by the gravel pack. It then becomes necessary to clean the gravel pack of its accumulation of fine particles. Such cleaning is done by agitating the gravel pack by forcing liquid in the well outwardly from the well into the pack to loosen accumulated fine sand which can then flow into the well and be removed from the well through the eduction pipe. To accomplish such cleaning, the eduction pipe, with the development head at its lower end, can repeatedly be pulled up by the crane 18 and allowed to drop down under the force of gravity. When there is fluid in the well 10 and perforations in the casing 24 which lead to a gravel pack 26, the reciprocating action of the head, acting through the wipers, drives the fluid in the well through the casing perforations and the gravel pack 26. The fluid surging through the gravel pack loosens the fine particles and sediment trapped in the gravel pack and allows them to flow into the well 10 along with the fluid. As the fluid supply is replenished through the formation 12, this dirtied fluid can be drawn through the perforations 54 into the inner conduit 38 and out of the well 10. The overall flow is out of the well and the gravel pack 26 eventually becomes as clean as the fluid in the formation will allow. Combining suction and surging allows the gravel pack 26 and the casing perforations to be cleaned quickly.

The development head can also be used in the same way, reciprocation with combined suction, to agitate the gravel pack around a newly completed well so that the gravel can order and classify itself with its finer constituents close to the exterior of the well casing and its larger constituents closer to the undisturbed formation. This is desirable to initially define the desired filter effect in the gravel pack.

Both the suction head and the development head permit localized development and pumping of a well. It is not necessary that the heads be operated at the very bottom of the well. The heads permit the operator to perform desired tasks at any point along the well and to draw material out at any location within the well. Localized development and sampling is particularly important in environmental wells so that the environmental status of the formation can be monitored at different locations within the well.

The eduction pipe may be used with other heads or with no head at all. The air fitting 32 may be supplied with a different fluid, for example, water under pressure and the bracket 36, hook 20, crane 18 and truck 16 may be replaced with some other device for raising and lowering the eduction pipe and reciprocating it within the well. The eduction pipe and heads may be used both for development and for pumping substances out of the pipe and the apparatus may be applied to environmental, water and other types of wells. The outlet fitting 34 can be connected through a hose to a reservoir or the hose may allow the outlet fluids to run off onto the ground.

Other modifications and variations of the present invention are possible without departing from the spirit and scope thereof. The preceding description of presently preferred aspects and embodiments of the invention is not an exhaustive catalog of all of the structures and procedures which can be used to practice this invention. Therefore, the following claims are to be read in that light consistent with the foregoing illustrative descriptions.

What is claimed is:

1. A development tool useful for conditioning and developing a drilled environmental water monitoring well for uncontaminated flow into the well of fluids from a geologic formation pierced by the well through perforations in a well casing of selected size at the formation, the tool being comprises of a) a development head support pipe assembly sized for disposition in the well casing, the pipe assembly having first and second parallel passages therealong and having an eduction nozzle assembly coupled between the first and second passages near a lower end of the pipe assembly for discharging a pressurized first fluid in the first passage energetically only upwardly into the second passage, b) a tubular development head connectible coaxially to the pipe assembly lower end with the interior thereof in flow communication with the second passage, the development head (i) being perforated at selected locations along its length, (ii) being smaller in diameter than the well casing, and (iii) carrying circumferentially thereof an annular wiper sized to make loose sliding fit with the casing to enable the pipe assembly and head to be reciprocated in the casing for pumping of fluid in the casing into and out of the casing through the casing perforations in response to reciprocation of the development head, and c) means operable during reciprocating motion of the pipe assembly and the development head for pumping a first fluid under pressure through the first passage and through the education nozzle assembly to pump liquid entering the development head out of the well through the second passage.

2. The tool of claim 1 wherein the development head comprises two spaced apart outer wipers around the exterior of the head, and wherein the head is perforated between the wipers.

3. A method for developing an environmental water well having a perforated casing in a geologic formation from which water can seep into the well, the method comprising the steps of reciprocating in the casing at the formation a development tool to surge water in the well from the well through the casing into the formation and from the formation into the well, and pumping water and sediments in the well from the well via the development tool while performing the reciprocating step, the pumping step being performed without exposure of the formation and the well to fluids different from fluids occurring in the formation.

4. The method according to claim 3 wherein the pumping step includes discharging a pressurized pumping fluid energetically only upwardly into a flow conduit extending upwardly in the well from an inlet at the development tool.

5. The method according to claim 4 including using air as the pumping fluid.

6. The method according to claim 4 including discharging the pumping fluid into the flow conduit at a location proximately above the development tool.

* * * * *

UNITED STATES PATENT AND TRADEMARK OFFICE

CERTIFICATE OF CORRECTION

PATENT NO. : 5,069,285

DATED : December 3, 1991

INVENTOR(S) : Thomas E. Nuckols

It is certified that error appears in the above-identified patent and that said Letters Patent is hereby corrected as shown below:

In the Drawings:

FIG. 2 is omitted, insert FIG. 2, as shown on the attached page.
FIG. 3, delete FIG. 3 (second occurrence).

Column 3, line 28, before "invention" insert -- present --.
Column 3, line 29, after "a" change "we" to -- well --.
Column 3, line 32, after "inserted" insert -- into a --.
Column 3, line 36, before "invention" insert -- present --.
Column 3, lines 37,38, after "double-wall" insert -- pipe --.
Column 3, line 39, after "4-4 in" insert -- FIG. --.
Column 3, line 41, before "connection" insert -- slip --.
Column 3, line 42, after "and" insert -- 3; --.
Column 3, line 44, before "nozzle" insert -- eduction --.
Column 3, line 45, before "elevation" insert -- enlarged --.

Column 8, line 39, change "comprises" to -- comprised --.

Signed and Sealed this

Fourth Day of May, 1993

*Attest:*

Michael K. Kirk

MICHAEL K. KIRK

*Attesting Officer*

*Acting Commissioner of Patents and Trademarks*